United States Patent [19]

Gauss et al.

[11] 4,086,596

[45] Apr. 25, 1978

[54] WHIP ANTENNA ASSEMBLY AND METHOD OF MANUFACTURE

[75] Inventors: Robert C. Gauss; Hemant T. Sathe; Lynn D. Wills, all of Schaumburg, Ill.

[73] Assignee: Motorola, Inc., Schaumburg, Ill.

[21] Appl. No.: 669,001

[22] Filed: Mar. 22, 1976

[51] Int. Cl.[2] ..... H01Q 1/32; H01Q 9/18

[52] U.S. Cl. ..... 343/715; 343/749

[58] Field of Search ..... 343/715, 749, 895, 873, 343/900

[56] References Cited

U.S. PATENT DOCUMENTS

| | | | |
|---|---|---|---|
| 2,841,789 | 7/1958 | Bassett | 343/749 |
| 3,267,476 | 8/1966 | Finke | 343/715 |
| 3,461,455 | 8/1969 | Rowe | 343/749 |
| 3,828,353 | 8/1974 | Majkrzak et al. | 343/895 |

*Primary Examiner*—Eli Lieberman

*Attorney, Agent, or Firm*—Victor Myer; James W. Gillman

[57] ABSTRACT

There is disclosed an antenna including an accurately formed whip member and an accurately formed loading coil one end of which is connected to one end of the whip member and the other end of which is connected to a single connector. The length of the whip member and its diameter and any associated metallic connector are selected to give a predeterminedly accurate capacitive value. The loading coil has a predeterminedly accurate inductive value such that the loading coil and whip member have a net accurate inductive value which is connected to a predeterminedly accurate capacitor for matching the impedance of the antenna to the conductor, coaxial cable for example, from the transmitter. The capacitor, a single stub connector, the end of the coaxial cable and the necessary connections are epoxy encapsulated in a base housing.

The connector at the end of the loading coil is attached to the single stub connector in the base to provide the only connection necessary for the antenna to become operative.

The loading coil is very accurately formed by a two-step molding process wherein the turns are first held in position by a first molding step followed by a second overmolding step which connects and holds the associated parts together. The overall accuracy thus obtained is such that no adjustments in the factory after assembly, nor in the field are necessary and the voltage standing wave ratio of the antenna throughout the operating frequency band (Citizens Band) is no greater than two to one.

4 Claims, 11 Drawing Figures

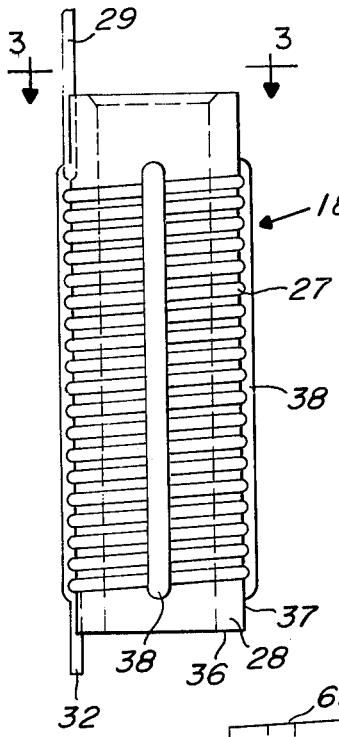
Fig. 2
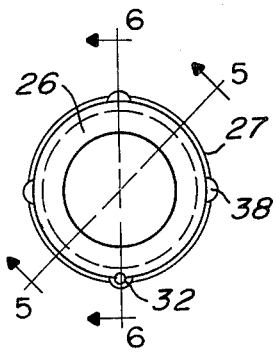
Fig. 3
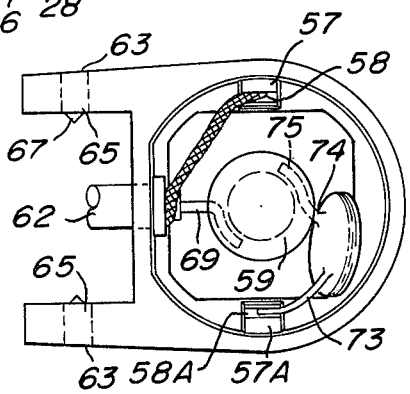
Fig. 1B
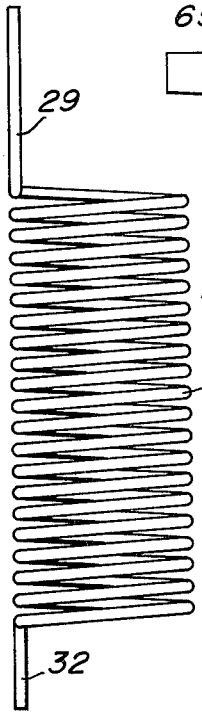
Fig. 4
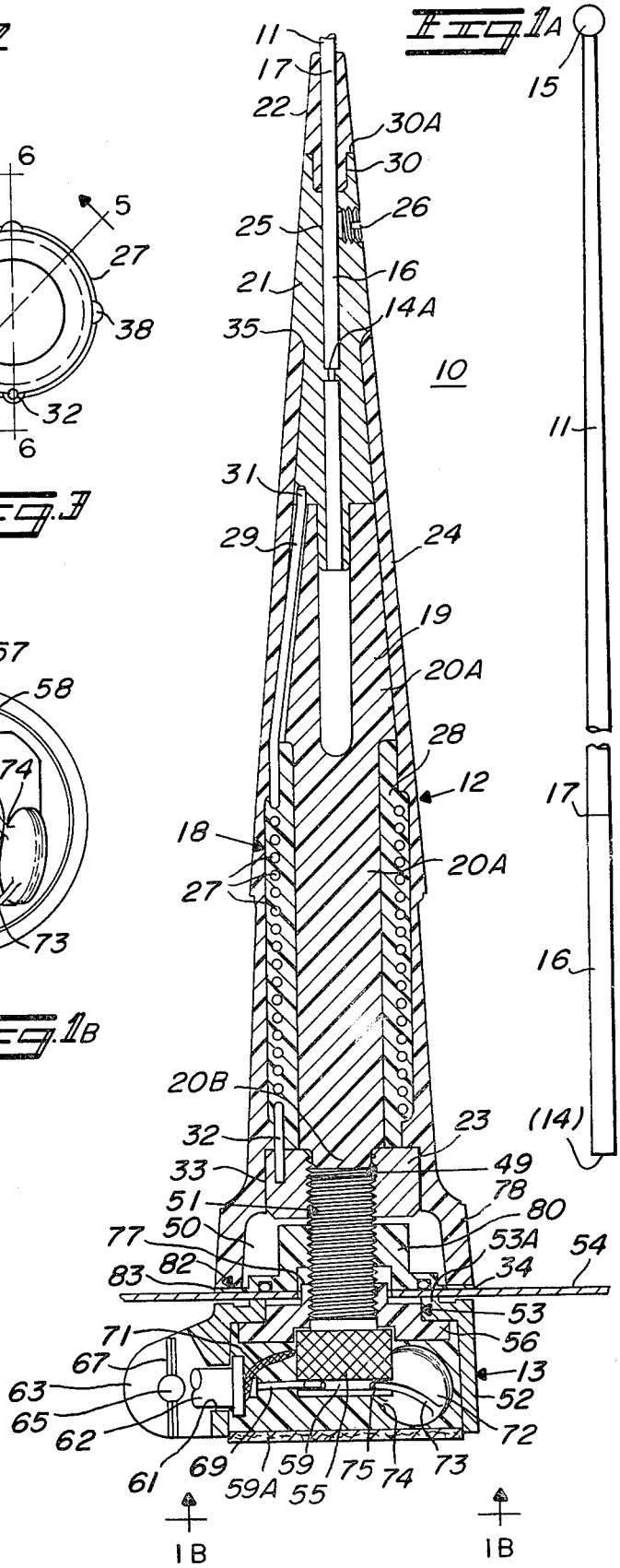
Fig. 1
Fig. 1A

WHIP ANTENNA ASSEMBLY AND METHOD OF MANUFACTURE

RELATED APPLICATIONS

This application is related to the application of Robert C. Gauss and Lynn D. Wills, filed Mar. 22, 1976 Ser. No. 668,944, entitled "Encapsulated Antenna Base", and assigned to the same assignee as the subject invention.

BACKGROUND OF THE INVENTION

This invention relates to mobile antennas and more particularly to such mobile antennas which when formed of a whip member and a loading coil do not require any adjustment, either at the factory, or at the installation, when connected by virtue of a single connector to a mounting base in order to maintain a low voltage standing wave ratio across the frequency band desired for example the Citizens Band frequency range.

In past constructions when a whip member has been cut to a given length and connected to its receptacle including a loading coil, individual adjustment has been necessary at the factory, or at the installation, in order to maintain the appropriate value of voltage standing wave ratio. More than one connection from the loading coil to the base has been necessary and the constructions have been susceptible to vibrations, shocks, etc., whereby reception by the antenna has been poor and the constructions have been expensive to fabricate.

SUMMARY OF THE INVENTION

It is an object of the invention to provide an improved base, loading coil mobile antenna which overcomes the objections of the prior art constructions.

It is a further object of the invention to provide an improved antenna of the nature indicated which does not require any adjustment after the final assembly steps have been taken.

It is a further object of the invention to provide an improved antenna of the nature indicated which is efficient, requires no final adjustment, and is inexpensive to manufacture.

In carrying out the invention in one form there is provided an antenna for a predetermined frequency band comprising in combination, a predetermined length of whip member and a loading coil of predetermined inductance value connected to the whip member for providing a precise inductive impedance of the whip and coil for matching to a transmission line with a standing wave ratio of a value no greater than about 2:1 throughout the band.

In carrying out the invention according to another form there is provided a method of forming an antenna for a predetermined frequency band comprising the steps of providing an accurate whip member of predetermined length, providing a loading coil having a predetermined number of turns, a predetermined diameter of turns, and a predetermined diameter of wire, interiorly molding said turns against the interior screw surface of a mold whose threads have the same diameter, pitch and groove diameter as the corresponding dimensions of the coil, providing an interconnecting metal member between one end of the whip member and one end of said coil, overmolding the assembly of the loading coil and the metal member and attaching the whip member to the metal member.

BRIEF DESCRIPTION OF THE DRAWINGS

FIG. 1 is an elevational view partially in section of an antenna construction according to the invention;

FIG. 1A is an elevational view of the antenna whip;

FIG. 1B is a bottom view taken substantially in the direction of arrows 1B—1B of FIG. 1;

FIG. 2 is an elevational view of the loading coil utilized in the invention in a preliminary stage;

FIG. 3 is an end view of the preliminary stage coil taken substantially in the direction of arrows 3—3 of FIG. 2;

FIG. 4 is a diagrammatic view of a spiral coil of wire wound according to the invention;

DESCRIPTION OF THE PREFERRED EMBODIMENT

Figure 5:
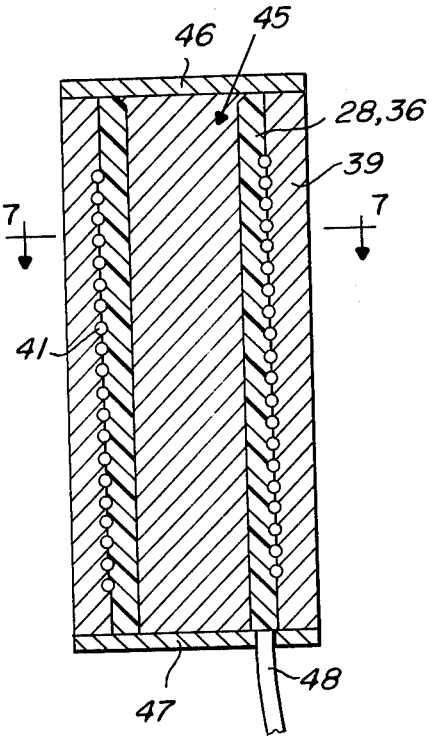
FIG. 5 is a diagrammatic sectional view of a mold for the first step molding of a coil and would be taken essentially in the direction of arrows 5—5 of FIG. 3, when the coil was in the mold.
Figure 6:
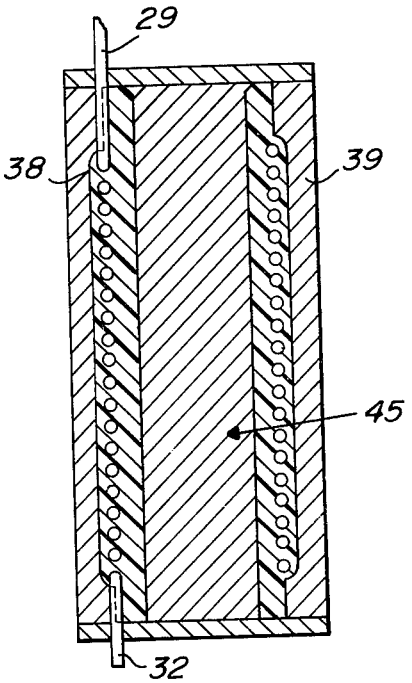
FIG. 6 is a diagrammatic sectional view similar to FIG. 5 but which would be taken in the direction of arrows 6—6 of FIG. 3 when the coil was in the mold.

Referring to the drawings, there is shown an antenna 10 comprising a whip 11, a loading coil assembly 12 and a base 13.

The whip 11 is the main radiating portion of the antenna and comprises a stainless steel wire or rod, having a conducting layer, for example, copper, plated thereon, the antenna whip appearing black because the copper is given an oxide treatment for weather protection and appearance. The length of the whip may be of any value desired for particular conditions but in the particular case wherein the antenna is used in the Citizen Band range the length from end 14 to point 15 is 49.25 inches. The end 16 for a distance of about 19½ inches to point 17 has a diameter of 0.100 inch and from point 17 to end 15 there is a straight taper from 0.100 inch to 0.048 inch at end 15.

The loading coil assembly 12 comprises a coil of copper wire 18, a central supporting and stiffening member, or insert 19, an antenna rod clamp 21, a flexible collar 22, a threaded base nut 23, and an overmolded cover 24.

The insert 19 is formed as a separate molded part having a tapered portion 20 and a shank portion 20A.

The whip 11 is received through a central bore in the collar 22 and into a central bore 25 in the antenna clamp 21 until the end 14 reaches the shoulder 14A as shown, the whip being held in the clamp 21 by some means, such, for example, as a set screw 26.

The coil 18 comprises an accurate number of turns of wire 27 which are accurately held as by an injection molding process in a molded sleeve 28, one end 29 extending up to and firmly connected, as by crimping, in a hole 31 at the lower end of antenna clamp 21, the other end 32 of the coil extending downwardly and being firmly held as by crimping in a hole 33 formed in the base nut 23. Thus a continuous electrical circuit will extend from the base nut 23 through the coil end 32, the turns of 27 of the coil, the end 29, the antenna clamp 21, and to the antenna whip 11. Surrounding and firmly holding in precise relationship the base nut 23, the coil 18, the insert 19, and the antenna clamp 21 is the molded cover 24 extending as shown from the point 34 to the point 35.

It is an important feature of the invention that once the antenna has been assembled at the factory, no adjustment is required, either at the factory, or at the installation in order to maintain the low value of voltage standing wave ratio (VSWR) across the band, namely the Citizens Band in the present instance. This requires accuracy at all stages of manufacture including the length of the antenna whip 11, the dimensions of the antenna clamp, and the dimensions and other constants of the coil 18.

The loading coil assembly 12 is formed in a two step molding process wherein a coil of wire 27 is first molded into a coil including the support member 28 to give an assembly 18 which in the final process is over molded by the cover 24, the second molding step.

Referring to FIGS. 2 through 7 inclusive the construction of coil 18 in its preliminary or first molding stage may be understood. The coil 18 in this preliminary state comprises the coil of wire 27 molded onto a support member (sleeve) 28 to form an integral separate unit 18 as may be seen best in FIG. 2. The support 28 is essentially a hollow cylindrical core 36 in the outer surface 37 of which the turns 27 are partially embedded. Spaced equidistantly around the core 28 are four longitudinally extending embossments 38 which are integrally molded with the core 36 and the upper surfaces of which extend above the outer extremities of the turns 27. Extending from one end of the turns or coil 27 is the terminal end 29 and extending from the other end of the turns 27 is the terminal end 32. By virtue of the turns 27 being partially embedded in the outer surface of the core 36 and by the embossments 38, the turns 27 are rigidly held in their precise position of spacing between turns. The inductance value of the coil can thus be very accurately predetermined. Construction of the coil 18 to the extent described is known in the art and as such is not part of the invention except as it enters into the complete combination being described.

Figure 7:
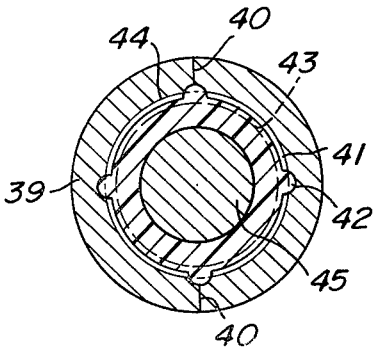
FIG. 7 is a sectional view taken substantially in the direction of arrows 7—7 of FIG. 5.

In FIG. 4 the turns 27 are shown wound in the same manner as a coil spring. The size of the wire, the diameter of the turns, the spacing of the turns, and the lengths of the ends 29 and 32 have been accurately predetermined in order to give the desired inductive value. The series of turns 27 is then placed inside of a cylindrical member or cavity 39 (FIGS. 5, 6, and 7) which has spiral grooves 41 disposed on its interior surface which conform to the wire size, turn diameter, and spacing between turns of the turns 27. Thus the turns 27 when disposed interiorly of the cavity 39 are held within the spiral grooves 41. Also interiorly of the cylindrical cavity 35 are four longitudinally disposed grooves 42 (FIG. 7) which form the embossments 38. In FIG. 7 the dotted circle 43 represents the inside diameter of the turns of wire 27 and thus represents the extent of embedment of the turns of the core member 36. In this same figure the circle 44 represents the outside diameter of the groove in the cylindrical mold 35 and also represents the exterior diameter of turns 27. The mold may be split at the lines 40 for permitting removal of the molded coil.

After the series of turns 27 (coil) has been disposed inside of the cylindrical cavity 39, a central core member 45 of appropriate diameter is disposed centrally of the molding cavity, and as shown diagrammatically, closing end members 46 and 47 are appropriately disposed to close the molding cavity. Thereafter molding compound such as acrylonitrile — butadiene — styrene, for example, is injected under pressure through an appropriate opening 48 to form the completed coil 18 as shown in FIG. 2. After the molding process is carried out, the mold is disassembled and the coil removed, all as is well understood in this art, and as previously indicated the manufacture of the coil itself is known to the art and is utilized in the present invention only in the total combination. It is essential that the inductance of the coil be accurately formed which requires that the turns be accurately held in the coil.

Forming the coil 18 as described is the first molding step and over molding with the cover 24, which may be of the same molding compound as used for the coil 18, is a second molding step. As has been described the molding of the cover 24 is carried out after the coil 18, the insert 19, the base nut 23 and the antenna clamp 21 are assembled together. This assures dimensional stability of the coil during the final molding step, allows use of less expensive, uninsulated wire for the coil itself and is compatible with automated assembly processes.

When assembled as described, the length of the whip 11 has been selected to extend to shoulder 14A in antenna clamp 21, the distance between point 14A and the crimp at 31 and the length of terminal end 29 have been selected, the constants of the series of turns 27 have been selected, and the length of terminal end 32 to crimp at 33 has been selected in order to give the desired inductive value for cooperation with the appropriate matching impedance in the base 13 to be further described to assure that a voltage standing wave ratio of no greater than 2:1 throughout the Citizens Band is obtained by the antenna combination. Because of the accurateness with which the coil 18 may be formed, as described, and the dimensions of the other components selected, after final assembly at the factory no further adjustment of the inductive value, or of the assembled antenna are necessary.

According to one form of coil 18 as described, the wire was copper, the diameter of the turns from center to center of the wire was 0.750 inches, the wire size was 14 gage AWG, the distance between turns was 0.091 inch and the coil had 20 turns. Other combinations may of course be selected to be taken in combination with the antenna clamp and the length of whip etc.

The terminal end 29 of the coil 18 lies in a groove formed in the tapered end 20 of the insert 19.

The base nut 23 is of course firmly held by the outer molded cover 24 and is provided with a threaded bore 49 which is force fitted onto the stub 20B of the insert and is adapted to receive the threaded connecting screw 51 which forms part of the base 13.

The collar 22 is of some relatively compliant material such as some form of rubber or elastomer, and includes a portion 30 of reduced diameter received in a corresponding opening at the upper end of the whip clamp member 21. The collar 22 while compliant is still relatively stiff and prevents the whip 11 from bending sharply at the juncture 30A where the whip member 11 in effect enters the metallic portion of the antenna clamp.

The antenna clamp 21 may be made of any suitable metal such as brass, for example, or Zamac, a well-known die casting type of material. Similarly for the material of the base 13.

The base 13 comprises a metallic housing, or skirt, 52, which may be of cast metal if desired. The base is open at the bottom as shown and is provided with a circular opening 53 at the top which has a diameter less than the outer diameter of the skirt 52 in order to form a shelf for resting against the attaching metal 54 of vehicle in the event that that is the mode of attachment of the antenna to the vehicle. Protuberances 53A extend upwardly from the shelf to engage the undersurface of sheet metal 54.

The connecting screw 51 includes a base portion 55 disposed within the skirt portion 52 and an insulating washer 56 is adapted to be disposed between the connecting screw stud portion 50 and the opening 53. Interiorly of the skirt 52 there are a pair of embossments 57 and 57A, the lower portion of which include slots 58, 58A, respectively. The base portion 55 of the connecting screw also has a slot or groove 59 for receiving conductors as will be described. The casting, or skirt 52, includes an opening 61 through which the coaxial cable 62 to the Citizens Band radio is received. Spaced apart ears 63 extend from the casting 52 and are provided with bores 65 through which screws may be received for attaching the antenna base to the vehicle in this fashion. Sharp protuberances 67 may be provided on the interior surfaces of the ears 63 for assistance in this aspect.

The center conductor 69 of the coaxial cable 62 is crimped to the base 55 at the slot 59 and the braid or ground 71 of the coaxial cable is crimped to the embossment 57 at the slot 58 for example.

A capacitor 72 of appropriate capacitive value is disposed interiorly of the skirt, or casing, 52 and has two terminals or leads 73 and 74. Lead 74 is attached to the base portion 55 by crimping in the slot 59 at 75, for example, and the lead 73 is attached to the casting 52 as for example by crimping in the slot 58A of embossment 57A (FIG. 1B).

The dielectric constant of the material encapsulating the coil 27 is between 2.4 and 3.8.

When the base portion 55, the capacitor 72, and the coaxial cable 62 are disposed in position and the connections as described are made, the space inside of the skirt 52 is filled with an epoxy compound. This completely encapsulates all of the components referred to and forms an integral unitary structure, hermetically sealing these components so that only a single contact point, namely the threaded stud 50 of screw 51 protrudes from the base for connection to the antenna proper. The encapsulation does not completely fill the space inside of skirt 52. The remaining space is filled with a resilient member 52A. The capacitor 72 forms part of an impedance matching network extending between the input coaxial cable 62 and the antenna loading coil 27 whereby a voltage standing wave ratio of no greater than 2:1 is maintained throughout the band, without further adjustment either at the factory, after assembly, or at the place of installation.

If the antenna is to be installed by attaching to the metal 54 of a vehicle, an opening 77 is provided therein through which the stud 50 of the connecting screw is received. Surrounding the stud 50 and extending through the opening 77 is a collar 64 forming part of insulating washer 56 as shown thereby insulating the center connector 51 from the vehicle metal. The threaded stud 50 is then received in an insulating nut 80 this nut then being screwed down until the antenna base is held securely against the under portion of the vehicle metal. An "O" ring 84 may be used to provide weatherproofing of the opening 77. The portion of the threaded stud 50 protruding above the insulating nut 80 is then received in the threaded bore 49 of the antenna. The antenna is screwed down until the skirt portion 78 of the molded outer cover 24 bottoms on the flange 83 of the insulating nut 80, which protects the painted finish of the vehicle metal from abrasion. If the antenna is attached to the vehicle by virtue of the ears 63 the antenna base is screwed to the projecting stud 51 until the lower edge of the skirt 78 engages the upper edge of skirt 52. This gives the single point contact desired. In this manner of attachment, the insulating nut is eliminated.

Figure 8:
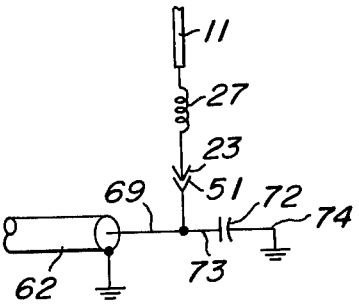
FIG. 8 is a circuit diagram showing an antenna connected to the conductor from the transmitter.

Referring to FIG. 8, the antenna circuit, as connected to a vehicle, is shown, the reference characters in FIG. 8 being the same for corresponding parts as in the previous figures described. Thus the antenna whip 11 is connected to the loading coil 27 which ends in a single connector, or base, nut 23. The nut 23 receives the single stud 50 which is connected to the center conductor 69 of the coaxial cable 62 and the capacitor 72 has a lead 73 connected to the stud 50 and a lead 74 connected to ground. The capacitor 72 matches the inductive effect of the combined loading coil 27 and whip 11 to the impedance of the coaxial cable 62 throughout the frequency band.

Figure 9:
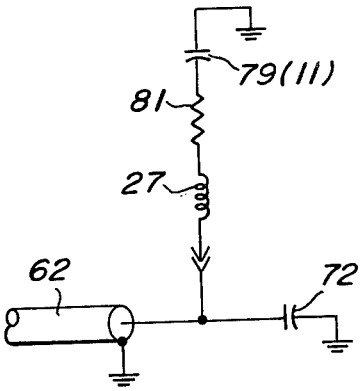
FIG. 9 is a circuit diagram representing the antenna circuit.

In FIG. 9 the equivalent electrical circuit is shown and in this figure also the same reference characters are used for corresponding parts. The antenna whip 11 is shown as a capacitor 79 and radiation resistance 81. The inductance of the loading coil 27 together with the capacitor 79, corresponding to the antenna whip, give a net inductive effect which is balanced against the capacitance of the capacitor 72 in order to give impedance matching needed. At some point throughout the frequency band circuit comprising the capacitance 79 inductance 27 and the capacitance 72 will be resonant and at other frequencies the circuit will be removed from resonance but never sufficiently far to make the standing wave ratio greater than 2:1 throughout the whole frequency band.

According to one form of the invention described, the inductance value of the coil 27 was 5 micro henries, the capacitance value of the whip was 7 picofarads, and the capacitance value of capacitor 72 was 160 picofarads. The band width of the Citizen Band is 26.965 MHz to 27.255 MHz, and it is this band width that the constants set out in the foregoing specification have been selected for in order to give a standing wave ratio of not greater than 2:1 throughout the band width.

Other constants, of course, may be used, for other frequency bands, or conditions of operation.

We claim:

1. The method of forming an antenna for a predetermined frequency band comprising the steps of providing an accurate whip member of predetermined length, providing a loading coil having a predetermined number of turns, a predetermined diameter of turns, and a predetermined diameter of wire, interiorly molding said turns against the interior screw surface of a mold whose threads have the same diameters, pitch and groove diameter as the corresponding dimensions of said coil and forming for the length of said coil a hollow molded cylinder whose interior diameter is less than the interior diameter of said turns, providing an electrically insulating supporting member interiorly of said hollow molded cylinder and said coil and exteriorly thereof at one end, providing an interconnecting metal member between one end of said whip member and said electrically insulating supporting member exteriorly of said coil, overmolding the assembly of said loading coil, the hollow molded cylinder, the electrically insulating supporting member exteriorly of said coil and the adjacent portion of said interconnecting metal member and attaching said whip member to said metal member.

2. An antenna for a predetermined frequency band comprising in combination a predetermined length of whip member, a loading coil of predetermined inductance, connected to said whip member for providing a precise inductive impedance of said whip and said coil for matching to a transmission line with a standing wave ratio of a value no greater than about 2:1 throughout the frequency band, said loading coil has a predetermined number of turns, a predetermined diameter of turns, a predetermined spacing between turns and the spacing of said turns is accurately predetermined, said predetermined accuracy of spacing of turns is maintained by interior injection molding a molding material against said turns while said turns are held against a threaded cavity whose turns correspond to those of said coil, said molding material comprising a hollow molded cylinder whose interior diameter is less than the interior diameter of said turns and whose exterior surface includes projecting embossments whose exterior diameter is at least equal to the exterior diameter of said turns, an electrically insulating supporting core member interiorly of said molding material and said loading coil throughout its length, a metallic whip positioning member disposed between one end of said whip member and one end of said loading coil, and an injection molded cover member surrounding said loading coil and a portion of said whip positioning member.

3. The antenna according to claim 2 wherein said core member includes a portion extending beyond one end of said loading coil, said metallic whip positioning member includes a base portion adjacent the extending portion of said core member and a whip receiving portion, and said injection molded cover member surrounds said loading coil, the extending portion of said core member and a whip receiving portion.

4. The antenna according to claim 3 including a compliant collar attached to the whip receiving portion of said whip positioning member for receiving one end of said whip member.

* * * * *